United States Patent [19]

Wolf

[11] 4,119,133

[45] Oct. 10, 1978

[54] INSULATED GARAGE DOOR

[75] Inventor: Cecil R. Wolf, Rock Falls, Ill.

[73] Assignee: Dwight Carter, Des Moines, Iowa

[21] Appl. No.: 803,480

[22] Filed: Jun. 6, 1977

[51] Int. Cl.[2] ..... E05D 15/38

[52] U.S. Cl. ..... 160/209; 160/201; 160/232

[58] Field of Search ..... 160/201, 209, 194, 195, 160/232; 49/DIG. 1

[56] References Cited

U.S. PATENT DOCUMENTS

| | | | |
|---|---|---|---|
| 1,869,347 | 7/1932 | Johnson | 160/209 |
| 2,007,688 | 7/1935 | McCloud | 160/209 |
| 2,045,060 | 6/1936 | Wheatley | 160/209 |
| 2,287,372 | 6/1942 | Blodgett | 160/113 |
| 2,350,288 | 5/1944 | Michelman | 160/195 |
| 2,880,796 | 4/1959 | Stroup | 160/232 |
| 3,034,575 | 5/1962 | Stroup | 160/209 |
| 3,079,987 | 3/1963 | Klein | 160/201 |
| 3,118,702 | 1/1964 | Kale et al. | 160/201 |
| 3,126,944 | 3/1964 | Kempinski | 49/197 |
| 3,227,205 | 1/1966 | Crosswell | 160/201 |
| 3,511,301 | 5/1970 | Graham et al. | 160/209 |

*Primary Examiner*—Peter M. Caun
*Attorney, Agent, or Firm*—Zarley, McKee, Thomte, Voorhees & Sease

[57] ABSTRACT

An insulated sectional overhead garage door comprising a plurality of pivotally connected door panels, each having an interior cavity filled with insulating material. Weather stripping is provided between adjacent door panels to prevent heat loss. One feature of the invention pertains to the quick mounting of the rollers to the panels by means of a pair of bushings and a spacer retainer. Another feature pertains to the movable vertical track for retaining the door in the closed position. The track is movable downwardly and toward the door jamb in response to movement of the door to its lowermost position. The upper end of the door is retained in a track having adjustment means for selectively adjusting the distance between the door header and the upper end of the door. The vertical track is movably mounted on an L-shaped frame member constructed of heat insulating material which is securely mounted to the door jamb.

14 Claims, 10 Drawing Figures

INSULATED GARAGE DOOR

BACKGROUND OF THE INVENTION

The invention relates to garage doors and more particularly, to an insulated sectional garage door.

Presently known sectional doors do not fit tightly in the doorway, resulting in heat loss around the doors and thereby defeating any insulating effect the door may have. These devices employ stationary upstanding tracks which are inclined away from the door jamb adjacent the upper end thereof. Due to manufacturing tolerances and inaccuracies it is difficult to maintain a close fit without considerable binding. Prior doors also experience heat loss between adjacent panels. They are cumbersome and difficult to install and once installed do not provide simple means for selective adjustment of the fit of the door against the jamb.

SUMMARY OF THE INVENTION

The present invention utilizes a sectional insulated garage door wherein the individual panels contain an interior space filled with insulating material and are pivotally connected with an insulating weather strip between adjacent panels. An integral open end channel is located at the outward edge of the panels. It closes the end of the door panel and provides quick, secure and precise mounting of the roller hardware. Slotted apertures are located in the end channels so the roller axles may be laterally inserted in the apertures while the roller head is engaged by the track assembly, thereby allowing mounting of individual separate door panels in the track assembly. Bushings are placed in the apertures and an arcuate shaped spacer retainer snaps over the axle to hold the bushings in place.

The track assembly comprises two horizontal overhead tracks and one movably mounted vertical track that cams in toward the door jamb upon closing to produce a tight heat insulating fit. As the door starts up, the track follows the cam and releases the door from the weather strip and moves away from the door jamb to create ample operating clearance from binding. The upper horizontal track guides only the top roller of the top door panel so that the top of the panel is guided tightly against the jamb and in alignment with the remaining panels. The jambward end of this track is pivotally mounted so as to be selectively movable by a screw adjustment after installation to provide precision alignment of the door relative to the jamb.

An L-shaped heat insulating frame member is attached to the door jamb and provides the support to which the vertical track is mounted. The vertical track contains a plurality of elongated cam slots outwardly disposed at the lower end and a flange bearing that rides in the cam slots. A bolt securely mounts the flange bearing to the frame member. The vertical track is movable during the final closing distance of the door corresponding to the length of the cam slots. A spring biases the track upward. When the lower roller of the door reaches the bottom of the vertical track it engages a roller stop at the bottom of the track and pulls the track downward during the final closing distance. As the track is pulled downward, the flange bearing riding in the cam slots causes the tracks and therefore the door to cam inward toward the doorway jamb for a tight fit. Weather stripping is located between the door jamb and the door panels and is compressed by this camming action. Weather stripping is also located at the bottom edge of the bottom panel for heat insulation.

It is a principal object of the invention to provide a garage door that is fully insulated and tightly fitting to a doorway.

A further object of the invention is to provide an insulated garage door that exhibits precision fitting to the doorway and prevents heat loss.

A further object of the invention is to provide an insulated garage door that has a movable vertical track that cams inward toward the door jamb.

A further object is the provision of an insulated door free from metal or other material capable of heat conduction between the interior and exterior of the building. Consequently a thermal break or barrier is not necessary to reduce heat conduction from the interior to the exterior of the building.

A further object of the invention is to provide an insulated garage door which minimizes the possibility of pinching the operator's fingers in the spaces between the panels.

A further object of the invention is to provide an insulated garage door that minimizes heat loss around the edges of the door and between the door panels.

A further object of the invention is to provide an insulated garage door that is simple and quick to install.

A still further object of the invention is to provide an insulated garage door that is adjustable after installation for precision alignment with the doorway.

A further object of the invention is the provision of a door having panels in two heights which may be used in varying combinations to produce door assemblies of various standard heights up to fourteen feet.

A still further object of the invention is to provide an insulated garage door that requires a minimum of maintenance and that is durable in use, economical to manufacture, and refined in appearance.

DESCRIPTION OF THE PREFERRED EMBODIMENT

Figure 1:
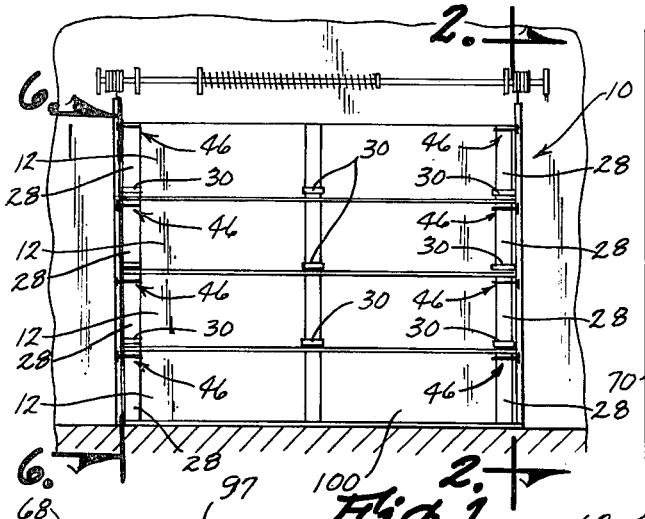
FIG. 1 is an interior elevational view of the invention installed in a doorway.

The numeral 10 generally designates the insulated door of this invention shown mounted in a doorway of FIG. 1. Door 10 is comprised of a plurality of individual panels 12 mounted together.

Panel 12 is constructed of a fiberglass pull extrusion manufactured by the Pultrusions Corporation, 1331 Chillicothe Road, Aurora, Ohio 44202 under the trademark "Glaspul". Each panel 12 is comprised of front wall 16 (FIGS. 7-10), back wall 18, top wall 22 and bottom wall 24 forming interior cavity 26. Cavity 26 is filled with an insulating material 27.

Figures 6, 7, 8, 9, 10:
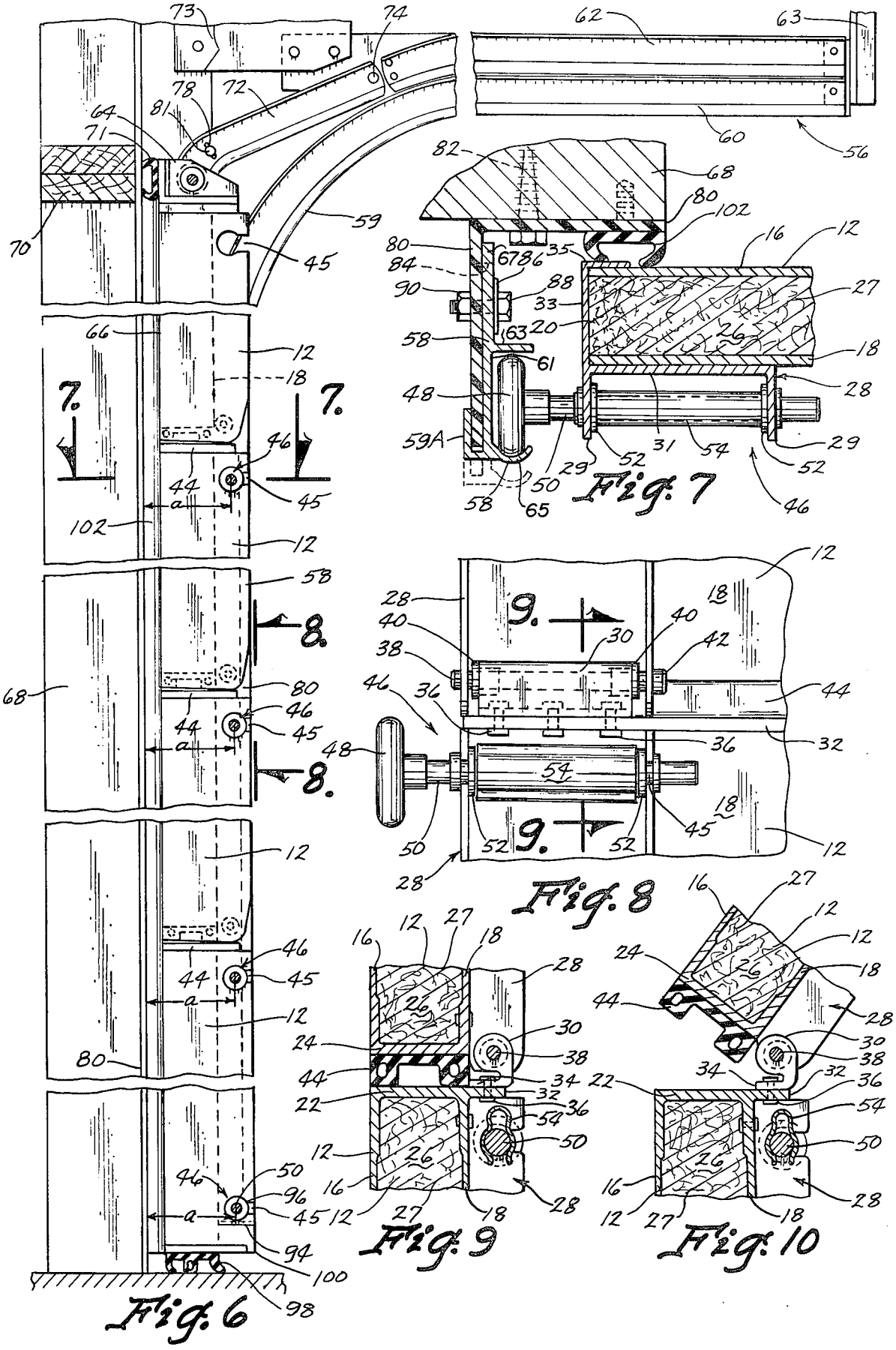
FIG. 6 is an enlarged partial side view seen on line 6—6 of FIG. 1.
FIG. 7 is an enlarged sectional view seen on line 7—7 of FIG. 6.
FIG. 8 is an enlarged sectional view seen on line 8—8 of FIG. 6.
FIG. 9 is a sectional view seen on line 9—9 of FIG. 8.
FIG. 10 is a sectional view similar to FIG. 9 illustrating the pivotal movement of an adjacent door panel.

An end channel 28 (FIGS. 1 and 7-10) is securely attached over each end 20 of panel 12 so as to be an integral part thereof and is outwardly disposed from rear wall 18. In cross-section channel 28 includes a pair of rearwardly extending legs 29 which are interconnected by a web 31 which tightly embraces the end of rear panel 18. Channel 28 also includes an L-shaped portion formed by legs 33, 35 which embrace the end edge of each panel 12 and the front portion 18 of each panel 12 respectively. Thus, the end of each panel 12 is embraced on the interior surface by web 31, on the end by leg 33, and on the front surface by leg 35 (FIG. 7). Channel 28 runs the full vertical length of panel 12, as can be seen in FIG. 1, and accordingly is rightly mounted thereto with a minimum of play in response to stresses upon channel 28.

Adjacent panels 12 are rotatably connected by a hinge 30 (FIGS. 8-10). Top wall 22 extends beyond back wall 18 forming lip 32 to which plate 34 of hinge 30 is attached by blind rivet 36 as shown in FIG. 9. Hinge 30 is pivotally mounted to the panel 12 adjacent lip 32 by means of hinge pin 38 extending through apertures (not shown) in end channel 28, bushings 40 and the bore (not shown) of hinge 30 as shown in FIG. 8. Hinge pin 38 is knurled under head 42 to prevent turning of pin 38 in the apertures (not shown) of end channel 28.

The upper panel 12 of FIG. 9 is shown pivoted clockwise via hinge 30 in FIG. 10. Weather strip 44 is attached to the bottom wall 24 and provides insulation between adjacent panels 12 when panels 12 are in vertical alignment as shown in FIG. 9.

The hinges 30 hold panels 12 in spaced relationship so that the distance between adjacent door panels prevents pinched fingers while the door is being closed to its lowered position.

End channel 28 also contains slotted apertures 45 as shown in FIG. 6 to receive and mount the roller assembly generally designated 46. Roller assembly 46 comprises roller head 48, axle 50, bushings 52 and spacer retainer 54. Spacer retainer 54 has a cross-sectional configuration as shown in FIGS. 9 and 10, and is pressed over the axle to securely hold the bushings 52 in place. Roller head 48 is attached to axle 50 and easily mounted in end channel 28 by placing bushings 52 on axle 50, passing axle 50 through slot 51 into apertures 45 with the bushings 52 within end channel 28, sliding bushings 52 into apertures 45 and snapping spacer retainer 54 over the axle to securely hold the bushings 52 in apertures 45 to form a floating axle which may slide inwardly or outwardly in response to variations in track assembly 56. A constant distance a (FIG. 6) is maintained between jamb angle 80 and the axis of roller assembly 46 because of the integral nature of end channel 28 to panel 12.

Track assembly 56 (FIG. 6) provides the guiding channel for roller heads 48 and comprises vertical track 58, bottom overhead track 60, top overhead track 62, torsion spring 73, and angle member 63 supporting the rearward ends of track 60 and 62. Bottom overhead track 60 is aligned with vertical track 58 by curved portion 59 so as to form a continuous track. Top overhead track 62 guides only the top roller 64 of the top panel 66 of door 10 as shown in FIG. 6. All other rollers 46 are guided by vertical track 58 and bottom overhead track 60.

Figure 2:
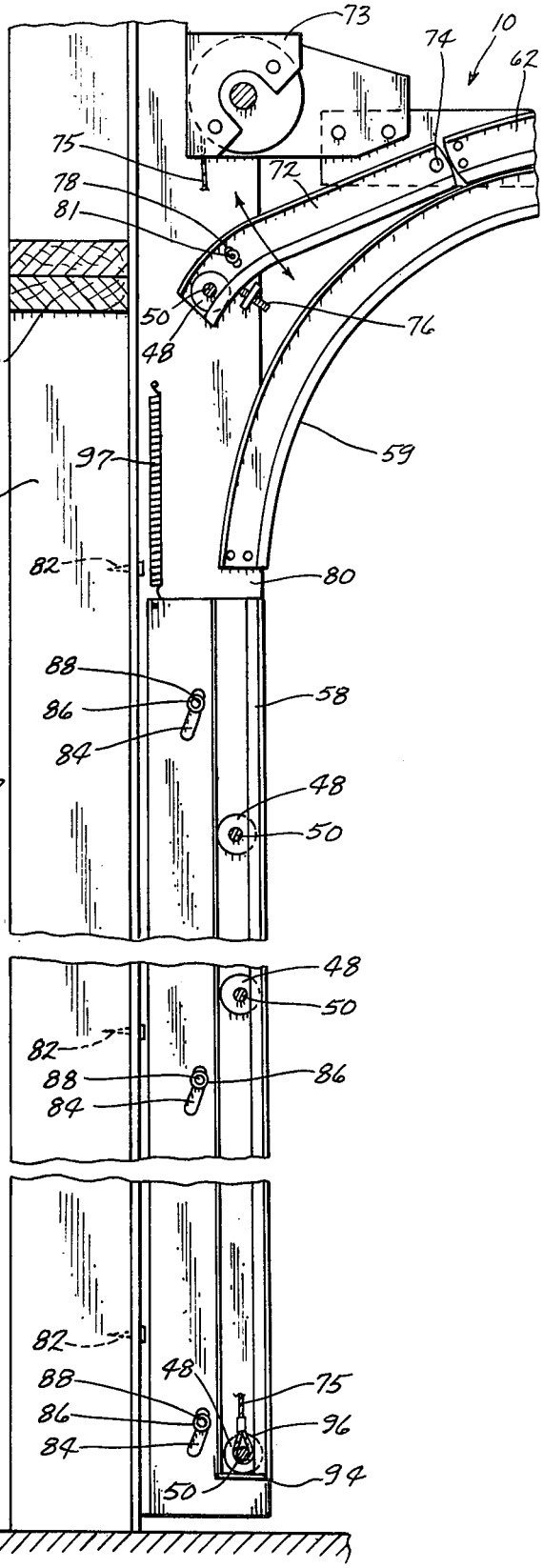
FIG. 2 is an enlarged partial side view seen on line 2—2 of FIG. 1.

Top overhead track 62 guides top roller 64 so that top panel 66 is aligned with doorway jamb 68 and header 70 as shown in FIG. 6. Top weather strip 71 is located between top panel 66 and header 70 to provide a heat insulating fit. Also shown in FIG. 2, forward track portion 72 of top track 62 is pivotal about pivot bolt 74. Screw adjustment 76 pivots forward track portion 72 in either direction as shown by the arrows in FIG. 2 to allow adjustment for proper fit after installation. The elongated shape of slot 78 prevents attachment screw 81 from inhibiting the pivotal action of forward track portion 72. Cable 75 connects torsion spring 73 to the bottom of door 10 and provides biasing assistance in raising door 10.

Jamb angle 80 as shown in FIG. 7 is securely attached to doorway jamb 68 by screws 82. Jamb angle 80 is L-shaped in cross-section and constructed of heat insulating, non-conducting material to prevent heat exchange between the interior and exterior of the building. A fiberglass pull extrusion material which may be used for angle 80 is manufactured by The Pultrusions Corporation, at 1331 Chillicothe Road, Aurora, Ohio 44202, under the trademark "Glaspul".

Figure 3:
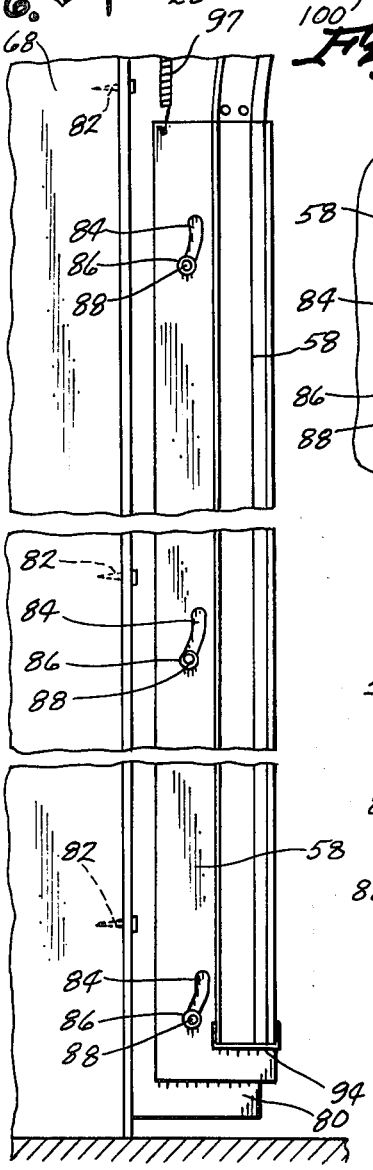
FIG. 3 is an enlarged partial side view similar to FIG. 2 with the door shown in an open position.
Figure 4:
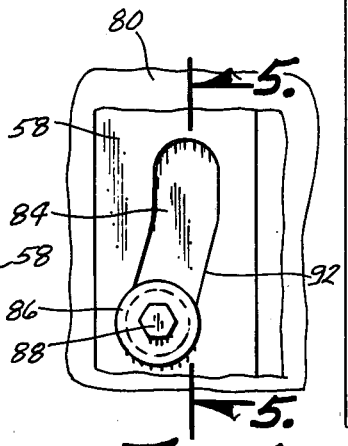
FIG. 4 is an enlarged partial view of the cam slot of FIG. 3.
Figure 5:
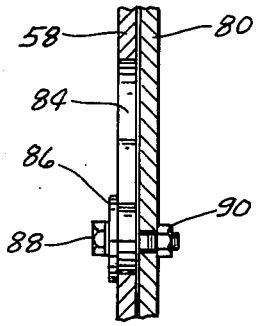
FIG. 5 is a sectional side view seen on line 5—5 of FIG. 4.

Track 58 includes a lip flange 59A (FIG. 7) which slidably embraces angle 80. Track 58 also includes a wheel receiving channel 61 formed by lips 63, 65. Extending from channel 61 towards door jamb 68 is a flange 67 having a plurality of cam slots 84 (FIG. 3). Mounted to angle 80 is an anchor bolt 88 which carries a bearing 86 and which is held in position by nut 90. Bearing 86 rides in cam slot 84 so as to facilitate and guide sliding movement of track 58 with respect to angle 80. The bottom portion of cam slot 84 is outwardly projecting as shown in FIG. 4 with a preferred angle approximately 15° relative to the top portion of cam slot 84. Track 58 is thus movable between an upper position shown in FIG. 3 to a lower position shown in FIG. 2. Spring 97 biases track 58 to its upper position.

Track 56 is provided with a stop 94 at the lower end thereof for engaging the rollers 48 of door 10 when door 10 approaches its lowermost position. As the door is lowered, rollers 48 engage stop 94 and force track 58 downwardly against the bias of spring 97. Bearings 86 and cam slot 84 cooperate during this downward movement to move track 58 and door 10 in unison towards door jamb 68. In this lowered position (FIGS. 6 and 7), door 10 fits snugly against the floor, against a weather strip 102 on the lateral sides of the door opening, and against the door header 70. The result is a sealed fit which minimizes passage of air around the margins of the door.

Bottom weather strip 98 is located at the bottom of bottom door panel 100 as shown in FIG. 6, while side weather strip 102 is attached to jamb angle 80 between panels 12 and jamb angle 80 as shown in FIG. 7, and extends the full height of door 10. Weather strips 44, 72, 98 and 102 are of pliable material to seal adjoining elements to prevent heat loss.

The easy assembly of roller assembly 46 facilitates installation of door panel 12 and each panel 12 can be individually mounted in track assembly 56. Once track assembly 56 is installed, a single panel 12 is placed in the opening and roller assembly 46 is then placed in track 58 and attached to panel 12 as described above. The process is repeated as the remaining panels are stacked one upon the other until the full door is completed. After the door is completed, screw adjustment 76 allows adjustment of track 62 so top door section 66 can be tightly aligned against jamb 68 and header 70.

Thus it can be seen that the device accomplishes at least all of its stated objectives.

What is claimed is:

1. A garage door assembly for a garage door opening having vertically disposed jambs on opposite sides thereof and a header extending between the upper ends of said jambs; said assembly comprising:

a track assembly having a pair of spaced apart tracks, each track having a horizontal upper portion and a vertical lower portion;

stop means on said vertical lower portion;

frame means mounted to said vertically disposed jambs;

mounting means movably mounting each of said vertical lower portions of said track assembly to said frame means for movement from an upper position to a lower position, said mounting means comprising a cam and a cam follower, one of said cam and cam follower being on said frame and the other of said cam and said cam follower being on said vertical portion of said track;

said cam follower being shaped to cooperate with said cam to guide said vertical portion of said track assembly toward said door jamb when said vertical portion moves from said upper to said lower position;

a flexible door having a plurality of rollers retentively guided in said track assembly whereby said rollers of said door are movable from a raised position to a lowered position wherein at least some of said rollers engage said stop means and urge said vertical portion of said track to said lower position;

said door comprising a plurality of enlongated horizontally disposed door panels hinged together in edge to edge relationship about horizontal axes, at least one of said rollers being positioned at each opposite end of each of said panels;

said horizontal upper portion of said track assembly comprising an upper horizontal track and a lower horizontal track, said rollers of at least the uppermost panel of said door being retentively mounted for rolling movement in said upper horizontal track;

at least a portion of said upper horizontal track being movably mounted with respect to the remaining portion of said horizontal track for movement toward and away from said door header; and adjusting means for retentively holding said movable portion of said horizontal track against movement from a plurality of selected positions with respect to said header, said adjusting means comprising an adjusting member selectively movably mounted with respect to said frame means and retentively engaging said movable portion of said horizontal track, said adjusting member being selectively movable to cause movement of said movable portion of said horizontal track toward and away from said header.

2. An assembly according to claim 1 wherein said cam follower comprises an elongated slot in said vertical portion of said track assembly, said cam comprising a roller mounted to said frame means and extending within said slot.

3. An assembly according to claim 1 wherein said mounting means comprise a plurality of cams and cam followers identical to said first mentioned cam and cam follower, said plurality of cams and cam followers being positioned to hold said track in vertical orientation throughout movement from said upper to said lower positions.

4. An assembly according to claim 1 wherein a weather strip is mounted between said door and said door jambs, said strip being compressed between said door and said door jamb whenever said door is in said lowered position.

5. An assembly according to claim 1 wherein said door panels comprises an interior cavity containing a heat insulating material.

6. An assembly according to claim 5 wherein the bottom door panel of said door has a weather strip thereon for engagement with the ground upon closing of said door.

7. An assembly according to claim 1 wherein said movable portion of said upper horizontal track is pivotally mounted for movement about a horizontal axis and includes a curved portion extending downwardly from said horizontal axis.

8. An assembly according to claim 7 wherein adjusting means comprises a screw adjustment for selectively pivoting said upper horizontal track about said horizontal axis.

9. A garage door comprising:

a plurality of door panels pivotally connected to form a door, each of said door panels having an interior cavity containing heat insulating material;

roller means attached to said door panels, a frame member attached to a doorway jamb, said frame member being vertically disposed with respect to said doorway jamb;

track means attached to said frame member for guiding and holding said roller means such that said door may move from a position closing a doorway to a position above said doorway thereby opening said doorway, said track means having a first horizontal track for holding and guiding said roller means attached to the top door panel, a second horizontal track for holding and guiding said roller means attached to said lower door panels, a vertical track and a curved track connecting said vertical track to said second horizontal track, and said first horizontal track comprising first and second track sections, said first track section being disposed between said second track section and said doorway jamb, said first track section being pivotally mounted for movement toward and away from said doorway jamb;

adjustment means selectively, movably mounted with respect to said frame member an retentively engaging said first horizontal track section, for continuous selective adjustment of said first horizontal track section toward and away from said doorway jamb such that said top panel is moved toward and away from said doorway jamb in response to movement of said adjustment means.

10. The device of claim 9 wherein said first track sectin is slidably mounted to said frame member.

11. The device of claim 9 wherein an adjustment bolt is mounted to said frame member and engages said first track section such that rotation of said bolt in one direction pivots said first track section about said pivot point toward said doorway jamb and rotation of said bolt in the other direction pivots said first track section away from said doorway jamb.

12. A sectional garage door comprising, a plurality of door panels pivotally connected to form a door said door panels having front and rear walls and opposite ends, said rear wall being disposed away from a doorway jamb and having an open end channel at each of said opposite ends;

a frame member attached to said doorway jamb, said frame member being vertically disposed with respect to said doorway jamb;

roller means detachably secured to said end channels, and track means for guiding and holding said roller means such that said door may move from a position closing a doorway to a position above said doorway thereby opening said doorway, said open end channel having two spaced apart vertical legs extending rearwardly away from said door frames, each of said vertical legs having a slotted aperture therein, each of said apertures in one of said spaced apart legs being in registered horizontal alignment with one of said apertures in the other of said spaced apart legs, said roller means comprising a wheel roller attached to an axle, said axle extending through said registered apertures;

a pair of bushings mounted on said axle for axial sliding movement thereon;

a spacer retainer yieldably retentively mounted over said axle between said bushings and holding said bushings within said apertures.

13. The device of claim 12 wherein said apertures are slotted, said slots being disposed from said apertures and away from said rear wall such that said axle may be laterally inserted into said aperture while said wheel roller is engaged to said track means and said spacer-retainer is open ended and arcuate shaped to clamp over said axle and hold said bushings in said apertures.

14. The device of claim 12 wherein said door panel comprises an interior cavity containing a heat insulating material.

* * * * *